US009995008B2

(12) United States Patent
Von Vett

(10) Patent No.: US 9,995,008 B2
(45) Date of Patent: Jun. 12, 2018

(54) SYSTEM AND METHOD FOR CONTROLLING VIBRATORY EFFORT ON ASPHALT MAT

(71) Applicant: Caterpillar Paving Products Inc., Brooklyn Park, MN (US)

(72) Inventor: Caleb D. Von Vett, Edina, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days. days.

(21) Appl. No.: 15/266,244

(22) Filed: Sep. 15, 2016

(65) Prior Publication Data

US 2018/0073204 A1 Mar. 15, 2018

(51) Int. Cl.
*E01C 19/40* (2006.01)
*E01C 19/48* (2006.01)
*E01C 19/38* (2006.01)

(52) U.S. Cl.
CPC ..... *E01C 19/4853* (2013.01); *E01C 19/38* (2013.01); *E01C 19/40* (2013.01); *E01C 2301/00* (2013.01)

(58) Field of Classification Search
CPC ..... E01C 19/4853; E01C 19/38; E01C 19/40; E01C 2301/00
USPC ..... 404/84.05–84.5, 113, 114, 117–120
See application file for complete search history.

(56) References Cited

U.S. PATENT DOCUMENTS 4,930,935 A * 6/1990 Quenzi ..... E01C 19/006 404/114
5,177,415 A 1/1993 Quibel et al.
6,129,481 A * 10/2000 Tapio ..... E01C 19/405 404/102
7,588,388 B2 * 9/2009 Hall ..... E01C 19/176 404/101
8,696,236 B1 4/2014 Frelich
8,998,530 B2 4/2015 Buschmann et al.
9,045,871 B2 6/2015 Graham et al.
2003/0082003 A1 * 5/2003 Potts ..... E01C 19/286 404/117
2005/0069385 A1 * 3/2005 Quenzi ..... E01C 19/006 404/114

(Continued)

FOREIGN PATENT DOCUMENTS

CN 204199153 3/2015
CN 104674637 6/2015

*Primary Examiner* — Raymond W Addie
(74) *Attorney, Agent, or Firm* — Oblon, McClelland, Maier & Neustadt

(57) ABSTRACT

A system for controlling a vibratory effort on an asphalt mat includes a screed having a screed frame, a screed plate, and a vibratory mechanism. The screed plate and the vibratory mechanism are mounted on the screed frame and the vibratory mechanism is configured to vibrate the screed frame. The system further includes a sensor mounted on the screed frame, and configured to generate signals indicative of a vibrating parameter of the screed frame. The system further includes a controller in communication with the sensor and the vibratory mechanism. The controller is configured to receive the vibrating parameter, and further compare the vibrating parameter to a threshold parameter. The threshold parameter is the decoupling point of the screed frame. The controller is further configured to control the vibratory mechanism to reduce the vibrating parameter when the vibrating parameter exceeds the threshold parameter.

15 Claims, 3 Drawing Sheets

(56) References Cited

U.S. PATENT DOCUMENTS

| | | | | |
|---|---|---|---|---|
| 2011/0091277 | A1* | 4/2011 | Biodrowski | E01C 19/402<br>404/114 |
| 2015/0063907 | A1 | 3/2015 | Graham et al. | |

* cited by examiner

SYSTEM AND METHOD FOR CONTROLLING VIBRATORY EFFORT ON ASPHALT MAT

TECHNICAL FIELD

The present disclosure relates to a paving machine, and more particularly relates to a system and a method for controlling a vibratory effort on an asphalt mat.

BACKGROUND

Paving machines are generally used for laying paving materials, such as asphalt, on a work surface. The paving machine includes a screed to receive the paving material from a hopper and to deposit the paving material on the work surface. A screed plate is coupled to a screed frame of the screed for leveling the paving material with respect to the work surface. During paving operation, the screed frame along with the screed plate is vibrated by a vibratory mechanism to provide effective compaction of the paving material to form an asphalt mat. The vibration of the screed frame may affect compaction of the paving material and productivity of the machine.

Typically, the vibration of the screed frame is adjusted below a decoupling point manually. However, manual adjustment of the vibration may be time consuming and a labor intensive process, which may further affect productivity of the paving machine. Moreover, manual adjustment of the vibration may lead to errors in setting-up of the screed as the decoupling point fluctuates based on a thickness of the mat, a paving speed, and a type of mix. Such errors may result in defects in the asphalt mat, such as inconsistencies or discontinuities in the compression of the asphalt mat and variation in thickness, texture, density and smoothness of the asphalt mat.

U.S. Pat. No. 9,045,871 discloses a paving machine with operator directed saving and recall of machine operating parameters. The paving machine includes an adjustable screed assembly. Actuators adjust the screed assembly into the plurality of different configurations. Sensors sense a respective configuration parameter indicative of the configuration of the screed assembly. A controller is configured to save a first set of parameters including the configuration parameters and save a second set of parameters including the configuration parameters in response. The controller is configured to recall one of the first set or second set of parameters, and adjust automatically the configuration of the screed assembly to correspond to the configuration parameters included in the recalled first set or second set of parameters.

SUMMARY OF THE DISCLOSURE

In one aspect of the present disclosure, a system for controlling a vibratory effort on an asphalt mat is provided. The system includes a screed having a screed frame, a screed plate, and a vibratory mechanism. The screed plate and the vibratory mechanism are mounted on the screed frame and the vibratory mechanism is configured to vibrate the screed frame. The system further includes a sensor mounted on the screed frame. The sensor is configured to generate signals indicative of a vibrating parameter of the screed frame. The system further includes a controller in communication with the sensor and the vibratory mechanism. The controller is configured to receive the vibrating parameter. The controller is also configured to compare the vibrating parameter to a threshold parameter. The threshold parameter is a decoupling point of the screed frame. The controller is configured to control the vibratory mechanism to reduce the vibrating parameter when the vibrating parameter exceeds the threshold parameter.

In another aspect of the present disclosure, a paving machine is provided. The paving machine includes a frame and a screed coupled to the frame. The screed includes a screed frame, a screed plate, and a vibratory mechanism. The screed plate and the vibratory mechanism are mounted on the screed frame and the vibratory mechanism is configured to vibrate the screed frame. The paving machine further includes a sensor mounted on the screed frame. The sensor is configured to generate signals indicative of a vibrating parameter of the screed frame. The paving machine further includes a controller in communication with the sensor and the vibratory mechanism. The controller is configured to receive the vibrating parameter. The controller is also configured to compare the vibrating parameter to a threshold parameter. The threshold parameter is a decoupling point of the screed frame. The controller is further configured to control the vibratory mechanism to reduce the vibrating parameter when the vibrating parameter exceeds the threshold parameter.

In yet another aspect of the present disclosure, a method for controlling vibratory effort of a screed frame on an asphalt mat is disclosed. The method includes receiving signals indicative of a vibrating parameter of the screed frame from a sensor mounted on the screed frame. The method also includes comparing the vibrating parameter with a threshold parameter. The threshold parameter is a decoupling point of the screed frame. The method further includes controlling a vibratory mechanism coupled to the screed frame to reduce the vibrating parameter when the vibrating parameter exceeds the threshold parameter.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
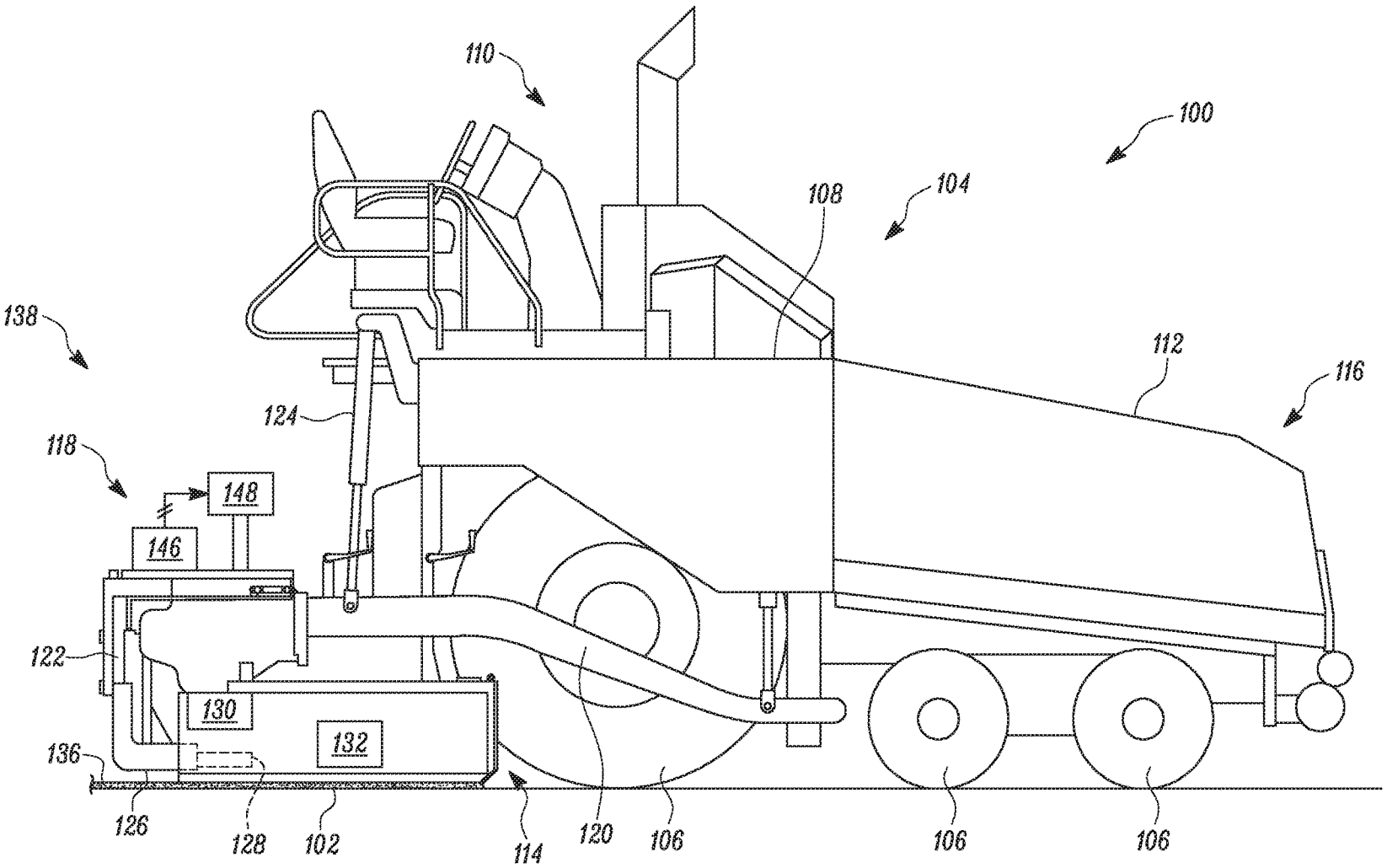
FIG. 1 is a side view of a paving machine used for laying an asphalt mat on a work surface, according to an embodiment of the present disclosure.

FIG. 1 illustrates a side view of a paving machine 100. The paving machine 100 may be used for laying asphalt on a work surface 102, such as a roadway. Although the paving machine 100 is depicted as an asphalt paver, it will be appreciated that the paving machine 100 may be any other type of paving machine for laying any type of paving material to form a layer of the paving material on the work surface 102.

The paving machine 100 includes a tractor 104 configured to propel the paving machine 100 on the work surface 102. In the present embodiment, the tractor 104 is a wheel type tractor including a plurality of wheels 106 for providing traction between the tractor 104 and the work surface 102. In another embodiment, the tractor 104 may be a track type tractor that may include tracks to provide traction between the tractor 104 and the work surface 102. However, in various embodiments, the tractor 104 may also include a combination of both tracks and wheels for providing traction between the tractor 104 and the work surface 102.

The paving machine 100 also includes a power source (not shown) for propelling the tractor 104. The power source may be disposed in the tractor 104 and configured to drive the plurality of wheels 106 for propelling the tractor 104. The power source may be, but not limited to, an internal combustion engine, or a hybrid engine. The paving machine 100 may further include a generator (not shown) coupled to the power source. The generator may be configured to supply electric power to various electric components of the paving machine 100.

The tractor 104 includes a frame 108 configured to support various components of the paving machine 100 including, but not limited to, an operator station 110, a hopper 112, and a screed 118. The operator station 110 is disposed adjacent to a rear end 114 of the tractor 104. The operator station 110 includes control levers and switches for an operator to control various operations, such as paving operation, of the paving machine 100.

The hopper 112 is coupled to the frame 108 adjacent to a front end 116 of the tractor 104. The hopper 112 may be configured to receive the paving material from a truck. The hopper 112 may include a conveyor (not shown) for transferring the paving material to the rear end 114 of the tractor 104. An auger (not shown) may also be coupled to the conveyor for spreading the paving material to the work surface 102 from the rear end 114 of the tractor 104. Additionally or optionally, the paving machine 100 may include a tamper assembly 136 for facilitating pre-compaction, or compaction of the paving material. The tamper assembly 136 may include a tamper bar (not shown) that may be an elongated member with a flat surface for engaging with the paving material. The tamper bar may be movably coupled to the frame 108 such that the tamper bar strikes a surface of the paving material for smoothening thereof.

The screed 118 is disposed at the rear end 114 of the tractor 104. The screed 118 is configured to spread and compact the paving material deposited on the work surface 102. The screed 118 includes a screed frame 122, and a screed plate 126 mounted on the screed frame 122. The screed frame 122 is connected to the frame 108. In an embodiment, the screed frame 122 is movably coupled to the frame 108, via a pair of arms 120 (one of which is shown in FIG. 1). The screed frame 122 is fastened to the pair of arms 120, which in turn connected to the frame 108 and one or more actuators 124. The actuators 124 may be configured to raise, lower, shift, and/or tilt the screed frame 122 to adjust a location and/or an orientation of the screed frame 122 with respect to the work surface 102.

The screed plate 126 is configured to compact the paving material deposited on the work surface 102. Specifically, the screed plate 126 contacts with the paving material deposited on the work surface 102 to level the deposited paving material with respect to the work surface 102. The screed plate 126 may be arranged as one of, but not limited to, a fixed width screed plate and a variable width screed plate.

In an embodiment, the screed 118 may additionally include a plurality of extension plates 128 disposed laterally with respect to the screed plate 126. Each of the plurality of extension plates 128 may be supported on an extension frame (not shown). The plurality of extension plates 128 may also be configured to contact the paving material deposited on the work surface 102 in association with the screed plate 126 for leveling the deposited paving material with respect to the work surface 102.

The screed 118 further includes a vibratory mechanism 130 mounted on the screed frame 122. The vibratory mechanism 130 is configured to vibrate the screed frame 122 and thus the screed plate 126. Specifically, the vibratory mechanism 130 aids in compaction of the paving material deposited on the work surface 102 by providing a vibratory effort, i.e. vibration of the screed plate 126. Owing to the vibration of the screed frame 122, the screed plate 126 strikes the paving material after the paving material is deposited on the work surface 102 and thereby, compact the paving material, such as asphalt, to form an asphalt mat 132 on the work surface 102. In an embodiment, the asphalt mat 132 may be defined as a layer of paving material having a predefined thickness, a predefined width, and a predefined compactness deposited on the work surface 102.

In the present embodiment, the vibratory mechanism 130 is a hydraulic motor. The vibratory mechanism 130 is mounted on the screed frame 122. The vibratory mechanism 130 rotates an eccentric mass (not shown) coupled to the screed frame 122, thereby inducing oscillatory or vibrational forces to the screed frame 122, which in turn are imparted to the screed plate 126. As the screed plate 126 vibrates, the oscillatory or vibrational forces are imparted to the paving material deposited on the work surface 102 for forming the asphalt mat 132. In various embodiments, the vibratory mechanism 130 may also be coupled to the screed plate 126 for vibrating the screed frame 122. Additionally or alternatively, each of the screed plate 126 and the plurality of extension plates 128 may be coupled to an individual vibratory mechanism 130 to vibrate the screed frame 122.

The paving machine 100 further includes a system 138 for controlling the vibratory effort of the screed frame 122 on the asphalt mat 132. In an embodiment, the system 138 is configured to adjust a vibrating parameter, such as amplitude, frequency, and phase of the vibration of the screed frame 122, for controlling the vibratory effort on the asphalt mat 132. In an example, the term "vibratory effort" may be defined as a vibration of the screed frame 122 optimally controlled based on the vibrating parameters of the screed frame 122 to compact the paving material deposited on the work surface 102.

Figure 2:
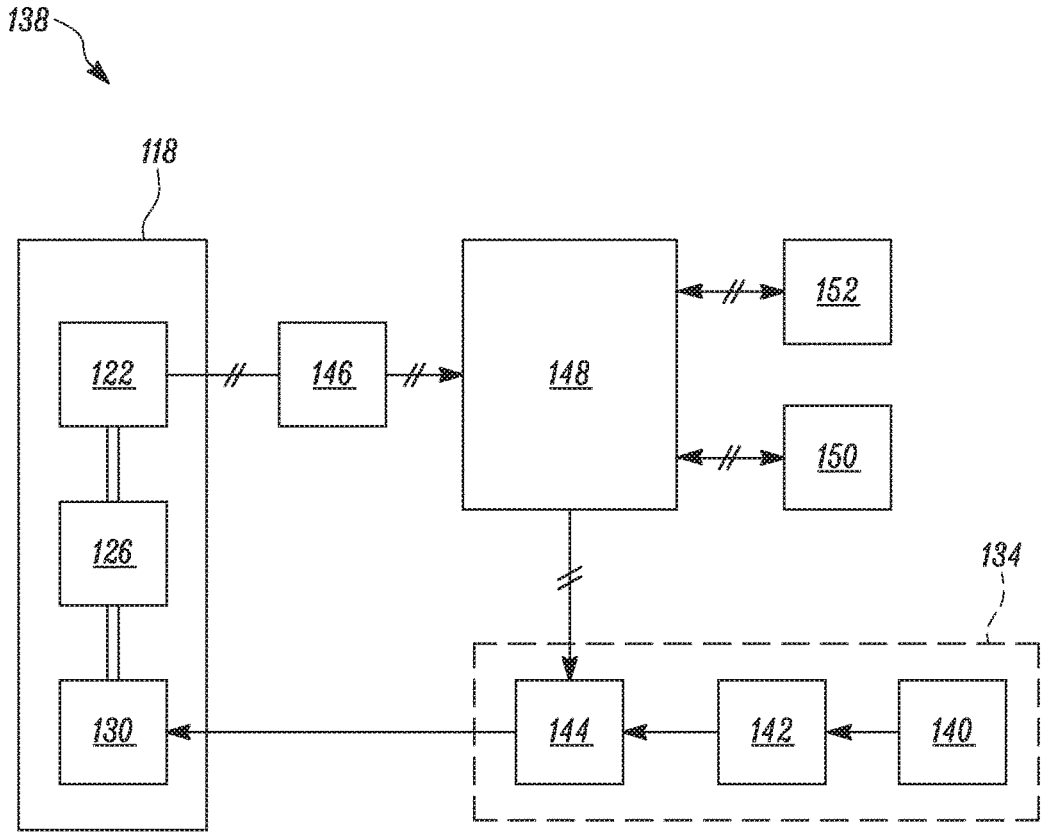
FIG. 2 is a block diagram of a system for controlling the vibratory effort on the asphalt mat, according to an embodiment of the present disclosure.

FIG. 2 illustrates a block diagram of the system 138 for controlling the vibratory effort of the screed frame 122 on the asphalt mat 132. In an embodiment, the system 138 includes the screed 118 having the screed frame 122, the screed plate 126 and the vibratory mechanism 130. As the vibratory mechanism 130 is a hydraulic motor, the system 138 of the present disclosure is configured to control a pressure of hydraulic fluid and a flow of hydraulic fluid to the vibratory mechanism 130 to adjust the vibrating parameter of the vibration.

The system 138 includes a sensor 146 mounted on the screed frame 122 of the paving machine 100. Although one sensor 146 is shown, it is understood that more than one sensor, similar to the sensor 146, may be coupled to each of the screed plate 126, and the plurality of extension plates 128. The sensor 146 is configured to generate signals indicative of the vibrating parameter of the screed frame 122. In the present embodiment, the vibrating parameter is amplitude of the vibration of the screed frame 122. Other vibrating parameters, such as the frequency of vibration of the screed frame 122, and the phase of vibration of the screed frame 122, may also be detected by the sensor 146.

In an embodiment, the sensor 146 is an accelerometer and is configured to determine the amplitude of the vibrations of the screed frame 122. However, it is understood that any type of sensors may be mounted on the screed frame 122 for generating signals indicative of the vibrating parameters such as the amplitude, the frequency and the phase of vibrations of the screed frame 122.

The system 138 further includes a controller 148 in communication with the sensor 146. The controller 148 may be configured to monitor the various vibrating parameters through the sensor 146 and to regulate various operating parameters of the vibratory mechanism 130 affecting vibration of the screed frame 122. In an embodiment, the controller 148 is a screed Electronic Control Module (ECM) located on the screed frame 122 of the paving machine 100. In other embodiments, the controller 148 may be a separate controller disposed at a remote location to the screed frame 122. The controller 148 is configured to receive the vibrating parameter from the sensor 146. The controller 148 may be connected to the sensor 146 using wired communication.

In an embodiment, the controller 148 may be implemented as one or more microprocessors, microcomputers, digital signal processors, central processing units, state machines, logic circuitries, and/or any device that is capable of manipulating signals based on operational instructions. Among the capabilities mentioned herein, the controller 148 may also be configured to receive, transmit, and execute computer-readable instructions. The controller 148 may also include a processor that includes one or more processing units, all of which include multiple computing units. The processor may be implemented as hardware, software, or a combination of hardware and software capable of executing a software application. The processor may be configured to receive signals indicative of the vibrating parameters through an interface and to determine a value of the vibrating parameter based on the received signals.

The controller 148 is also configured to compare the vibrating parameter to a threshold parameter which is a decoupling point of the screed frame 122. In an example, the decoupling point may be defined as a point at which the screed plate 126 loses surface contact with the paving material, while the screed frame 122 is vibrating to compact the paving material deposited on the work surface 102. The decoupling point may be determined based on the vibrating parameter of the screed frame 122, such as the amplitude, the frequency and the phase of vibrations of the screed frame 122.

As the vibrating parameter is the amplitude of the vibration of the screed frame 122, the controller 148 compares the amplitude of the vibration of the screed frame 122 to a threshold amplitude defined at the decoupling point of the screed frame 122. In an embodiment, the controller 148 may be configured to detect a spike in fluctuation of the amplitude to identify the decoupling point of the screed frame 122. In an embodiment, the controller 148 is also configured to compare a frequency of the vibration of the screed frame 122 with a preset frequency. The preset frequency may be defined based on a location of the sensor 146 on the screed frame 122 and harmonics of the vibration of the screed frame 122. In an embodiment, each of the various components of the screed 118, such as the screed frame 122 and the screed plate 126, is associated with a vibration frequency based on construction, structure, and material of the component. Hence, based on the location of the sensor 146 on the screed frame 122 or the screed plate 126, the controller 148 is preset with the vibration frequency of the component on which the sensor 146 is mounted. Presetting of the controller 148 based on the location of the sensor 146 on the screed 118 is preformed before the controller 148 is in operation for controlling the vibration effort of the screed frame 122 on the asphalt mat 132.

The controller 148 is in further communication with a database 150 to retrieve information pertaining to the threshold parameter which may be determined based on a lab test and simulation. The threshold parameter may be further determined based on historical data pertaining to the paving operation of the paving machine 100. The database 150 may store the threshold parameters related to various paving operations of the paving machine 100. Further, the processor of the controller 148 may select the threshold parameter for the paving operation stored in the database 150 and compare the threshold parameter with the vibrating parameter received from the sensor 146. In an example, the database 150 may include functions, steps, routines, data tables, data maps, and charts saved in and executable from a read only memory to compare the threshold parameter with the vibrating parameter of the screed frame 122 received from the sensor 146.

Further, the processor of the controller 148 may be configured to fetch and execute computer readable instructions stored in the database 150 to determine whether the vibrating parameter exceeds the threshold parameter. In an embodiment, the system 138 includes a user interface 152 for providing inputs pertaining to the threshold parameter, such as the threshold parameter and the preset frequency, to the processor of the controller 148. The user interface 152 may include one or more input devices for providing inputs pertaining to the threshold parameter. The input devices may include keypads, touch screens, dials, knobs, switches, wheels or combinations thereof.

Referring to FIG. 2, the controller 148 is in communication with a vibratory solenoid 144 of a hydraulic system 134 associated with the vibratory mechanism 130. The hydraulic system 134 includes a reservoir 140 for storing hydraulic fluid, and a pump 142 for drawing hydraulic fluid from the reservoir 140 to the vibratory mechanism 130. Further, the vibratory solenoid 144 is disposed downstream of the pump 142 to control a flow and a pressure of the hydraulic fluid flowing to the vibratory mechanism 130. The vibratory solenoid 144 may actuate a valve element (not shown) to control the flow and the pressure of the hydraulic fluid flowing to the vibratory mechanism 130, based on control signals received from the controller 148.

The controller 148 is configured to control the vibratory solenoid 144 to reduce the vibrating parameter, such as the amplitude, when the vibrating parameter exceeds the threshold parameter. In an embodiment, the controller 148 may also be configured to control the vibratory solenoid 144 to reduce the vibrating parameter based on a pressure of the hydraulic fluid flowing in the hydraulic system 134. Further, based on the comparison of the vibrating parameter with the threshold parameter and the pressure of hydraulic fluid, the controller 148 is configured to generate an output signal. The controller 148 communicates the output signal to the vibratory solenoid 144 in order to reduce the vibrating parameter below the threshold parameter. More specifically, upon receiving the output signal, the vibratory solenoid 144 is configured to reduce a flow rate and a pressure of hydraulic fluid flowing to the vibratory mechanism 130. As such, the controller 148 reduces a rotational speed of the vibratory mechanism 130, thereby reducing the vibrating parameter of the screed frame 122 below the threshold parameter of the screed frame 122, and controls the vibratory effort of the screed frame 122 on the asphalt mat 132.

In various embodiments, the controller 148 also increases the vibrating parameter to the threshold parameter when the vibrating parameter is less than the threshold parameter. In order to increase the vibrating parameter to the threshold parameter, the controller 148 regulates the vibratory solenoid 144 to increase the flow rate and the pressure of the hydraulic fluid flowing to the vibratory mechanism 130. As such, the controller 148 increases the vibrating parameter of the screed frame 122 to the threshold parameter of the screed frame 122.

Although in the illustrated embodiment, the controller 148 is shown as a single discrete unit, in other embodiments, the controller 148 and associated functions may be distributed among a plurality of distinct and separate components. Moreover, the controller 148 is shown to communicate with the database 150 to retrieve the threshold parameter, however, it is understood that the controller 148 may also be configured to store one or more set of threshold parameters. In such a case, the controller 148 may include access memory or secondary storage device. The memory and storage devices may be in form of read-only memory, random access memory or integrated circuitry that may be accessible by the controller 148. Further, in order to receive the vibrating parameter and send the output signal to the vibratory solenoid 144, the controller 148 may be operatively associated with the sensor 146 and the vibratory solenoid 144. The controller 148 may communicate with the sensor 146 and the vibratory solenoid 144 by sending and receiving digital or analog signals across electronic communication lines or communication busses, including by wireless communication.

INDUSTRIAL APPLICABILITY

Embodiments of the present disclosure may be implemented in the paving machine 100 in which the screed plate 126 is vibrated to achieve a predefined compactness for the asphalt mat 132. The present disclosure provides the system 138 and a method 300 for controlling the vibratory effort on the asphalt mat 132. The controller 148 assists in controlling the vibration effort of the screed frame 122 on the asphalt mat 132, based on signals received from the sensor 146. Hence, the screed frame 122 of the screed 118 may be effectively vibrated below the decoupling point in order to obtain the asphalt mat 132 of the predefined thickness, the predefined width, and the predefined compactness.

Figure 3:
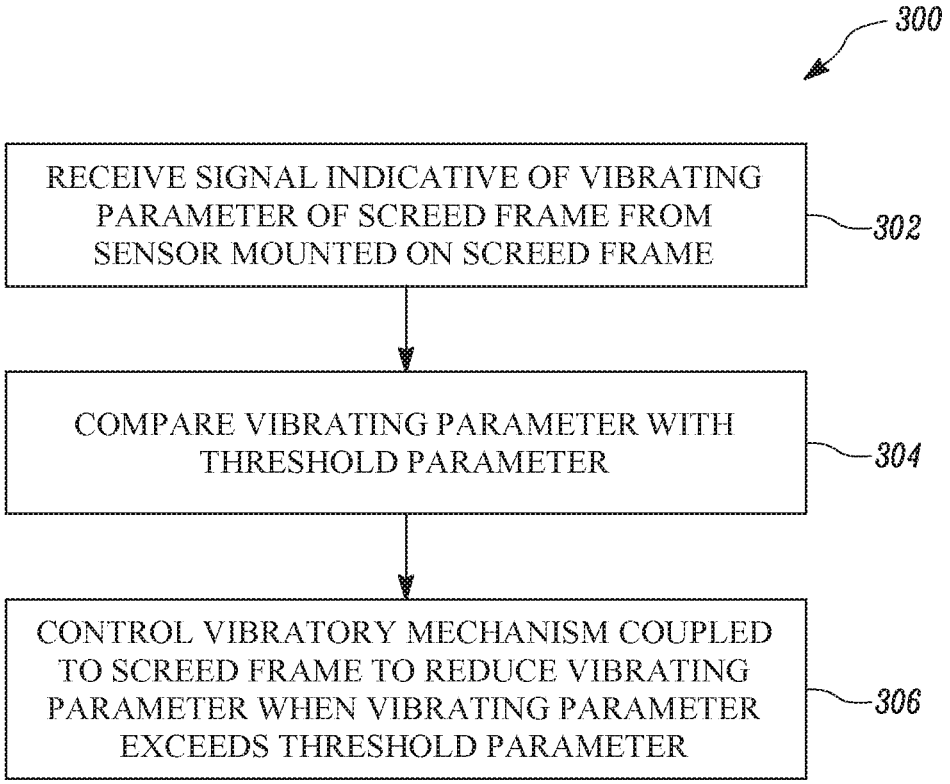
FIG. 3 is a flow chart of a method for controlling vibratory effort on the asphalt mat, according to an embodiment of the present disclosure.

A flow chart of the method 300 for controlling vibratory effort of the screed frame 122 on the asphalt mat 132 is illustrated in FIG. 3. Referring to FIG. 3, at step 302, the method 300 includes receiving the vibrating parameter of the screed frame 122 from the sensor 146. The sensor 146 is mounted on the screed frame 122 to generate signals indicative of the vibrating parameter of the screed frame 122. The sensor 146 may be an accelerometer to determine the amplitude of vibration of the screed frame 122. The controller 148, in communication with the sensor 146, receives the signals indicative of the vibrating parameter.

At step 304, the method 300 includes comparing the vibrating parameter with the threshold parameter. The threshold parameter is the decoupling point of the screed frame 122. In an embodiment, the vibrating parameter is amplitude of the vibration of the screed frame 122. The controller 148 compares signals received from the accelerometer with the threshold parameter that is the decoupling point of the screed frame 122. In an embodiment, the controller 148 compares the frequency of the vibration of the screed frame 122 that may be determined by the controller 148 based on signals received from the accelerometer.

The method 300 may also include generating the output signal based on the comparison of the vibrating parameter with the threshold parameter. Based on the comparison, the controller 148 generates the output signal that is communicated to the vibratory solenoid 144. The controller 148 may communicate with the vibratory solenoid 144 by sending digital or analog signals across electronic communication lines or communication busses, including by wireless communication.

At step 306, the method 300 includes controlling the vibratory mechanism 130 coupled to the screed frame 122 to reduce the vibrating parameter when the vibrating parameter exceeds the threshold parameter. The controller 148 regulates the rotational speed of the vibratory mechanism 130 for reducing the induced oscillatory or vibrational forces to the screed frame 122 such that the vibrating parameter is reduced below the threshold parameter. In an embodiment, the method 300 may include controlling the flow rate and the pressure of hydraulic fluid flowing to the vibratory mechanism 130 based on the output signal. Upon receiving the output signal, the vibratory solenoid 144 controls the flow rate and the pressure of the hydraulic flowing to the vibratory mechanism 130 for reducing the rotational speed of the vibratory mechanism 130 such that the vibrating parameter is below the threshold parameter. The method 300 includes controlling the vibratory effort of the screed frame 122 on the asphalt mat 132. In order to vibrate the screed frame 122 at the threshold parameter, the controller 148 increases the vibrating parameter to the threshold parameter when the vibrating parameter is less than the threshold parameter. As such, the vibratory or oscillatory forces experienced by the paving material on the work surface 102 is suitably controlled such that the vibrating parameter is maintained below or equal to the decoupling point. Thus, the paving machine 100 may effectively form the asphalt mat 132 having the predefined thickness, the predefined width, and the predefined compactness.

With the use and implementation of the system 138 and the method 300, the screed 118 of the paving machine 100 can be suitably controlled to form the asphalt mat 132. As the sensor 146 and the controller 148 are used to monitor and control the vibration of the screed frame 122, errors in compaction of the asphalt mat 132 onto the work surface 102 are minimized. Further, the system 138 and the method 300 may be suitably used in any paving machine that may include the tamper assembly 136 in addition to the screed 118. In such a case, a control of the tamper assembly 136 may be integrated with the operation of the system 138, thereby simplifying operation of the paving machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for controlling a vibratory effort on an asphalt mat, the system comprising:

a screed having a screed frame, a screed plate, and a vibratory mechanism, wherein the screed plate and the vibratory mechanism are mounted on the screed frame and the vibratory mechanism is configured to vibrate the screed frame;

one or more sensors mounted on the screed frame, and configured to generate signals indicative of vibrating parameters of the screed frame, the vibrating parameters including a phase of vibration and one or more of an amplitude of vibration and a frequency of vibration;

a memory configured to store historical vibrating parameter data corresponding to historical phase of vibration of the screed frame and one or more of historical amplitude of vibration of the screed frame and historical frequency of vibration of the screen frame; and a controller in communication with the one or more sensors, the vibratory mechanism, and the memory, the controller configured to:

identify the vibrating parameters from the signals indicative of the vibrating parameters, compare the identified vibrating parameters to respective threshold parameters, wherein each of the threshold parameters corresponds to a decoupling point of the screed frame, and each of the threshold parameters is set based on corresponding historical vibrating parameter data stored in the memory, generate at least one output signal based on the comparisons of the vibrating parameters with the respective threshold parameters, and control the vibratory mechanism, based on the generated at least one output signal, to reduce one or more of the vibrating parameters when the one or more vibrating parameters exceed the respective threshold parameters.

2. The system of claim 1, wherein the controller is in communication with a vibratory solenoid, and wherein the vibratory solenoid is configured to control a flow rate and a pressure of hydraulic fluid flowing to the vibratory mechanism based on the at least one output signal to control the vibratory effort of the screed frame on the asphalt mat.

3. The system of claim 1, wherein the vibrating parameters include the frequency of vibration of the screed frame, wherein the respective threshold parameter associated with the frequency of vibration is a preset frequency, and wherein the preset frequency is defined based on a location of at least one of the sensors, of said one or more sensors, on the screed frame, and harmonics of vibration of the screed frame.

4. The system of claim 1, wherein the controller is configured to control the vibratory mechanism, based on the generated at least one output signal, to increase one or more of the vibrating parameters to the respective threshold parameters when the one or more vibrating parameters are less than the respective threshold parameters.

5. The system of claim 1, wherein the vibratory mechanism is a hydraulic motor.

6. The system of claim 1, wherein at least one of the one or more sensors is an accelerometer.

7. A paving machine comprising:

a frame;

a screed coupled to the frame, the screed comprising a screed frame, a screed plate mounted on the screed frame, and a vibratory mechanism mounted on the screed frame, the vibratory mechanism configured to vibrate the screed frame;

one or more sensors mounted on the screed frame, and configured to generate signals indicative of vibrating parameters of the screed frame, the vibrating parameters including a phase of vibration and one or more of an amplitude of vibration and a frequency of vibration;

a memory configured to store historical vibrating parameter data corresponding to historical phase of vibration of the screed frame and one or more of historical amplitude of vibration of the screed frame and historical frequency of vibration of the screen frame; and a controller in communication with the one or more sensors, the vibratory mechanism, and the memory, the controller configured to:

identify the vibrating parameters from the signals indicative of the vibrating parameters, compare the identified vibrating parameters to respective threshold parameters, wherein each of the threshold parameters corresponds to a decoupling point of the screed frame, and each of the threshold parameters is set based on corresponding historical vibrating parameter data stored in the memory, generate at least one output signal based on the comparisons of the vibrating parameters with the respective threshold parameters, and control the vibratory mechanism, based on the generated at least one output signal, to reduce one or more of the vibrating parameters when the one or more vibrating parameters exceed the respective threshold parameters.

8. The paving machine of claim 7, wherein the controller is a screed Electronic Control Module (ECM) located on the screed frame.

9. The paving machine of claim 7, wherein the controller is in communication with a vibratory solenoid, and wherein the vibratory solenoid is configured to control a flow rate and a pressure of hydraulic fluid flowing to the vibratory mechanism based on the at least one output signal to control the vibratory effort of the screed frame on the asphalt mat.

10. The paving machine of claim 7, wherein the vibrating parameters include the frequency of vibration of the screed frame, wherein the respective threshold parameter associated with the frequency of vibration is a preset frequency, and wherein the preset frequency is defined based on a location of at least one of the sensors, of said one or more sensors, on the screed frame, and harmonics of vibration of the screed frame.

11. The paving machine of claim 7, wherein the controller is configured to control the vibratory mechanism, based on the generated at least one output signal, to increase one or more of the vibrating parameters to the respective threshold parameters when the one or more vibrating parameters are less than the respective threshold parameters.

12. The paving machine of claim 7, wherein the vibratory mechanism is a hydraulic motor.

13. The paving machine of claim 7, wherein at least one of the one or more sensors is an accelerometer.

14. A method for controlling vibratory effort of a screed frame on an asphalt mat, the method comprising:

receiving, from one or more sensors mounted on the screed frame, signals indicative of vibrating parameters of the screed frame, the vibrating parameters including a phase of vibration and one or more of an amplitude of vibration and a frequency of vibration;

identifying the vibrating parameters from the signals indicative of the vibrating parameters;

comparing the vibrating parameters to respective threshold parameters, wherein each of the threshold parameters corresponds to a decoupling point of the screed frame, and each of the threshold parameters is set based on corresponding historical vibrating parameter data stored in a memory, the historical vibrating parameter data corresponding to historical phase of vibration of the screed frame and one or more of historical amplitude of vibration of the screed frame and historical frequency of vibration of the screen frame;

generating at least one output signal based on the comparisons of the vibrating parameters with the respective threshold parameters; and controlling a vibratory mechanism coupled to the screed frame, based on said generating the at least one output signal, to reduce one or more of the vibrating parameters when the one or more vibrating parameters exceed the respective threshold parameters.

15. The method of claim 14, further comprising:

controlling a flow rate and a pressure of hydraulic fluid flowing to the vibratory mechanism based on the one or more output signals; and controlling the vibratory effort of the screed frame on the asphalt mat.

* * * * *